United States Patent [19]

Inglett, Jr.

[11] 4,345,629

[45] Aug. 24, 1982

[54] AUTOMATIC BAG HANGER

[75] Inventor: Wilfred L. Inglett, Jr., Augusta, Ga.

[73] Assignee: Inglett & Company, Inc., Augusta, Ga.

[21] Appl. No.: 228,592

[22] Filed: Jan. 26, 1981

[51] Int. Cl.[3] ..... B65B 3/16

[52] U.S. Cl. ..... 141/114; 53/573; 53/586; 141/313

[58] Field of Search ..... 53/571, 573, 586; 141/10, 68, 114, 166, 313–317; 414/128

[56] References Cited

U.S. PATENT DOCUMENTS 4,179,868 12/1979 Raiteri ..... 141/315 X

*Primary Examiner*—Frederick R. Schmidt

*Attorney, Agent, or Firm*—Kane, Dalsimer, Kane, Sullivan and Kurucz

[57] ABSTRACT

A bag hanger which pulls the upper portion of the bottom bag downwardly from a stack of bags in a magazine disposed at an angle to a generally horizontal position, opens the upper end of said bag, grips the side edges of the bag, completely removes the bag from the magazine, and transports the empty opened bag to a vertical position on a filling spout of a bagging machine. The stacked bags in the magazine are draped in their central area over a bag support roll shaft extending across the magazine.

10 Claims, 10 Drawing Figures

AUTOMATIC BAG HANGER

BACKGROUND OF THE INVENTION

1. Field of the Invention

The invention relates to machines for filling bags with bulk material and more particularly to an automatic machine for hanging empty bags upon a bag filling machine in proper position and without causing damage thereto.

2. Brief Description of the Prior Art

Many bulk materials, such as cement, grain, chemical compounds, livestock feed mixtures, and the like, are commonly placed in bags for commercial handling. Several machines have been devised for automatically filling bags with bulk material, the majority of such machines including a hopper in which the bulk material is placed. The empty bags, which may be of paper, cloth, a synthetic material, or any combination of these, is then placed below a filling spout on the hopper, and the spout is opened to permit the desired quantity of material to enter the bag. The present invention is directed to an automatic machine for removing an empty bag from a stack and properly placing it under the filling spout of such a bagging machine, and to associated bag handling apparatus.

The collapsed empty bags have been stacked horizontally or vertically. The bags have been removed from the front of the vertical stack or from either the top or bottom of the horizontal stack. The bag hanging machine of the present invention is constructed to store a supply of collapsed empty bags in a stack positioned between horizontal and vertical and to remove each bag from the bottom of the stack. The transfer arms of the invention are arranged to pick the bottom bag from the stack and to hang it vertically below the filling spout of the bagging machine. The present machine is an improvement over earlier machines in that the bag magazine can be easily loaded from the top with a large number of bags and the bottom bag of the stack can be quickly opened and transferred from the magazine to a filling spout without causing damage to the bags.

SUMMARY OF THE INVENTION

The invention comprises a machine for hanging empty opened bags on the filling spout of a bagging machine comprising:

a frame;

a magazine adapted to hold a plurality of bags in a stacked position;

a bag support roll shaft extending across the magazine in the central area of the magazine which bag divides the magazine into upper and lower portions with the upper portion disposed at an angle between vertical and horizontal and the lower portion at an angle nearer the vertical so that bags stacked in the magazine will assume a generally arcuate position over the bag support roll shaft;

lower vacuum means to pull the upper portion of the bottom bag of the magazine downwardly to a generally horizontal position;

upper vacuum means cooperating with the lower vacuum means to open the upper end of the said bottom bag;

a pair of spaced transfer arms pivotally mounted at the upper end thereof to said frame above said magazine, the lower ends of said arms being movable between the side edges of said horizontal opened bag and said spout;

means at the lower ends of said arms to clamp the side edges of the said opened bag to the transfer arms; and means for pivoting said transfer arms to pull the bag clamped to the transfer arms completely from the stack in the magazine and transfer such bag to the said spout.

DETAILED DESCRIPTION OF THE PREFERRED EMBODIMENT OF THE INVENTION

The bag hanging machine of the present invention is intended for use with automatic bagging machines of the type which dispense a specified amount of bulk material from a hopper into a bag suspended there below. Several such bagging machines are known to the art, and hence they will not be described in detail herein.

The subject bag hanger incorporates a magazine for storing a large plurality of empty, collapsed bags in a stack positioned between horizontal and vertical. The hanger is particularly suitable for large multiwall bags which may vary in width from 15 to 24 inches and in length from 24 to 40 inches. The magazine may hold from 200 to 250 bags. Although square gusseted bags are in wide use for packaging bulk materials, the machine of the present invention will work well with all types of bags whether gusseted or not. Cooperating with the magazine is an assembly which grips the end of the bottom bag of the magazine, opens the bag, grips it, pulls it from the magazine and hangs it vertically below the filling spout of the bagging machine.

Control circuitry is provided for interrelating the operation of the bag hanger with the bagging machine so that the opened bags can be fed to the filling spout as needed and commensurate with the speed of the bagging machine. Furthermore, the possibility of causing damage to tearable bags is minimized.

Figure 1:
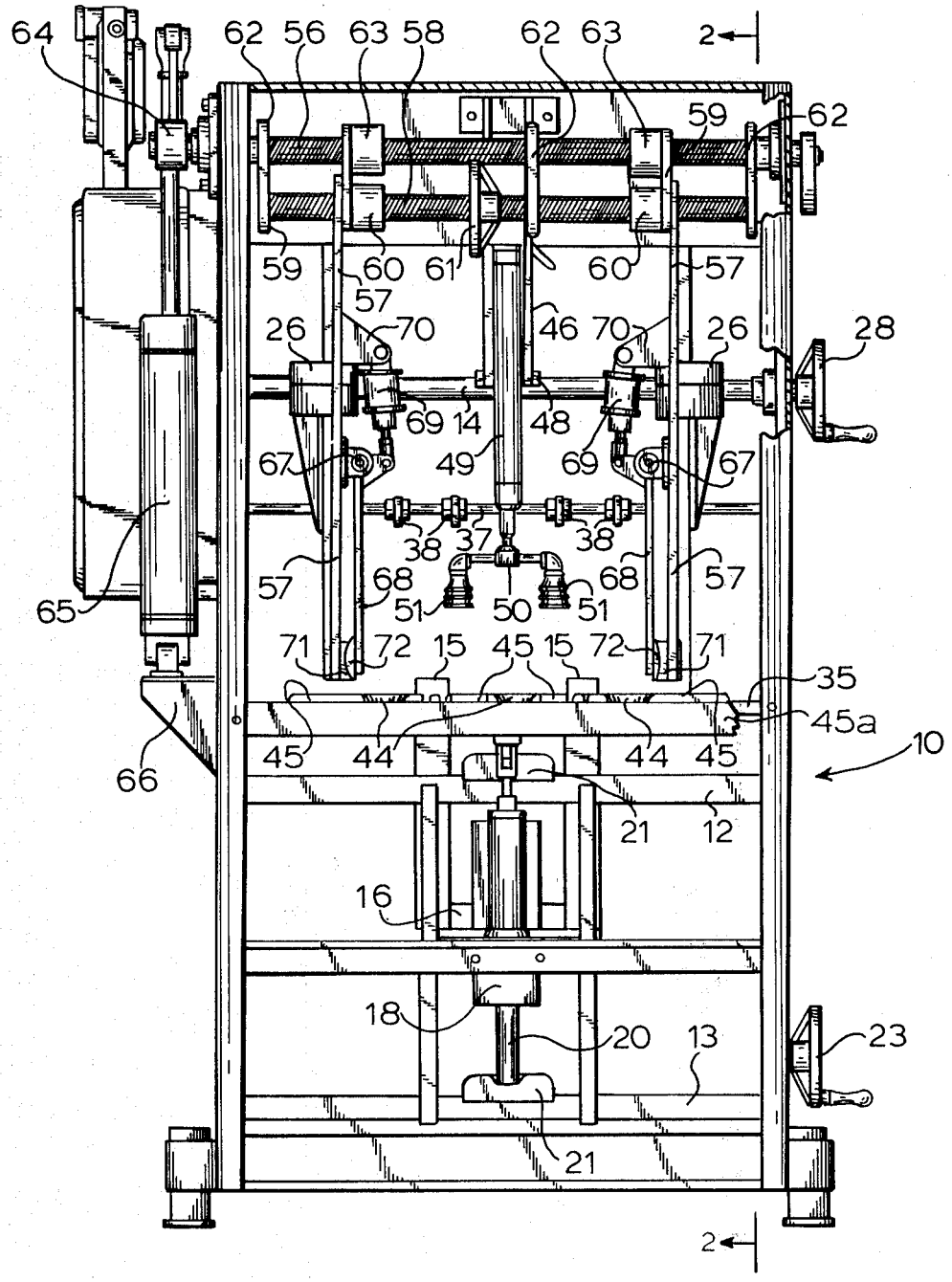
FIG. 1 is a front elevation of the machine of the present invention with some of the elements of the machine omitted.
Figure 2:
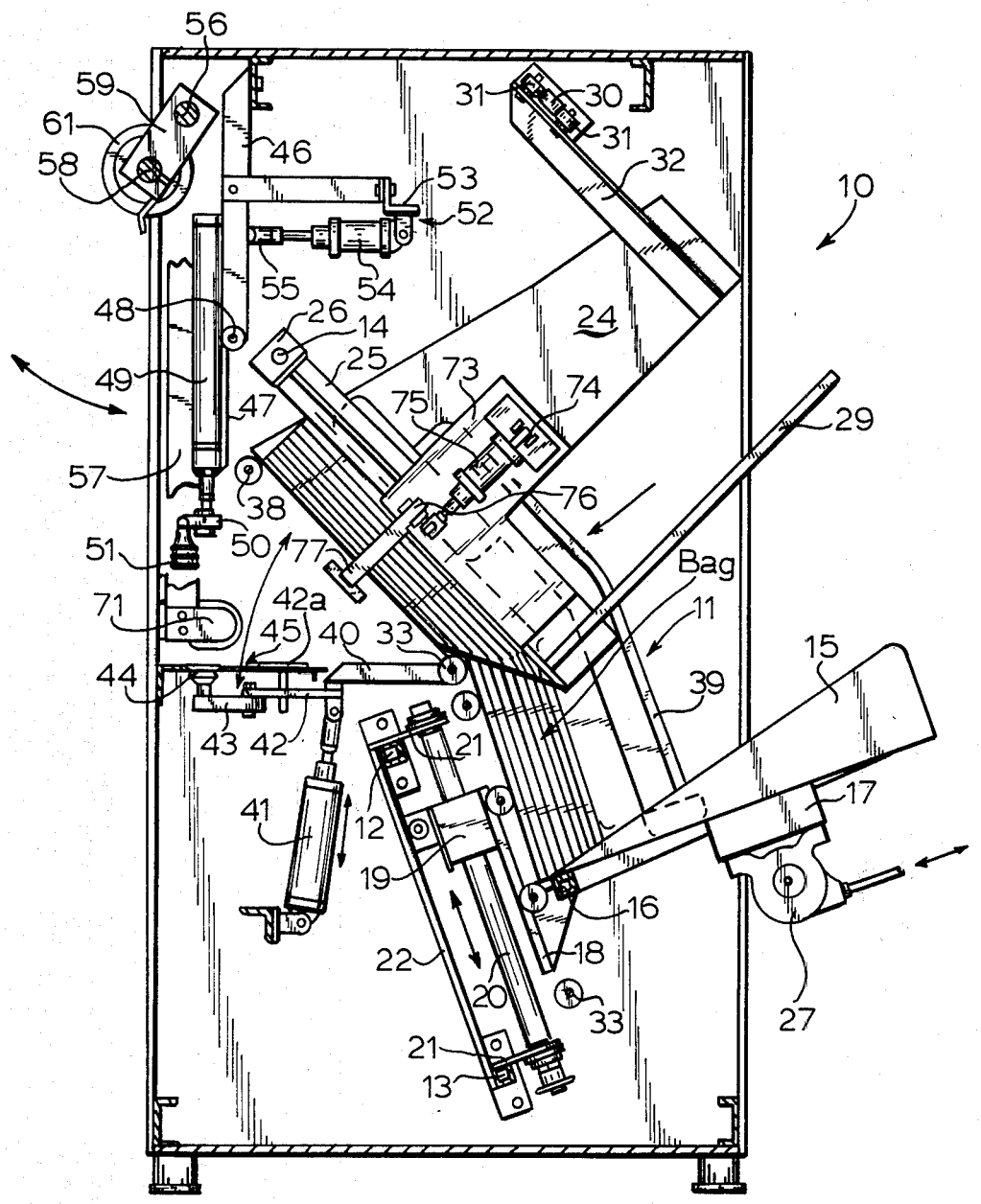
FIG. 2 is a side elevation of the machine with some of the elements of the machine broken away or omitted.

Referring to the drawings there is shown in FIG. 1 a main frame 10, which supports the various elements of the machine. The lower portion of the bag machine 11 is secured to a pair of rods 12 and 13 extending across the main frame 10 while the upper portion of the bag magazine is mounted on an adjusting screw 14 extending across the main frame (FIGS. 1 and 2). Such lower portion of the bag magazine consists of a pair of separated members 15 connected by a lower bar 16 and a plate 17 to form a U-shaped support for the bottom edges of the bags placed in the magazine. The bottom edges of the bags can rest directly on the tops of such members 15. Mounted on the plate 17 is a vibrator 27, the purpose of which will be explained hereinafter.

The members 15 are secured to and project from a base plate 18 mounted on a threaded block 19 cooperating with an adjusting screw 20 mounted on brackets 21 and a support 22 secured to the rods 12 and 13. By means of this adjusting assembly the screw 20 can be rotated to move the lower magazine members up or down to adjust for bags of different length. The screw 20 is connected to an adjusting wheel 23 on the main frame 10.

Figure 3:
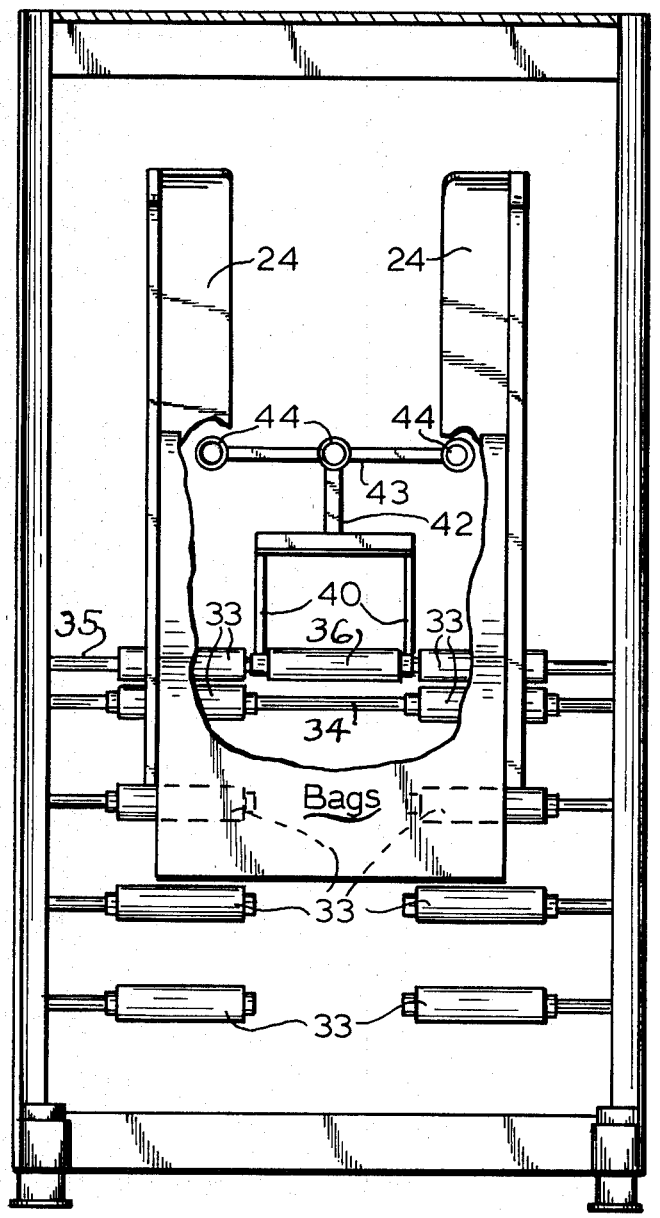
FIG. 3 is a rear elevation of the machine with some of the elements of the machine omitted.

The upper portion of the bag magazine consists of a pair of magazine side members 24 which are L-shaped plates to receive the corners of the tops of the bags (FIGS. 2 and 3). The spacing of these plates can be adjusted by an adjusting assembly to provide for bags of different width. The plates are supported by side frames 25 affixed to threaded blocks 26 cooperating with the adjusting screw 14 running across the main frame. An adjusting wheel 28 is affixed to the screw 14. Rods 29 are affixed to the side frames 25 to further maintain the position of the bags with the magazine. The magazine side members 24 are further supported at the top by a bar 30 running across the main frame. Rollers 31 affixed to strips 32 affixed to the said members ride over the bar 30 when the spacing of the side members is changed.

To support further the bags in the magazine a plurality of pairs of spaced rollers 33 project from the main frame (FIG. 3). In addition another pair of similar rollers 33 are mounted on a shaft 34 running across the frame. A bag support roll shaft 35 on which are mounted rollers 33 and a center roller 36 also runs across the frame. Another roll shaft 37 on which are mounted a plurality of small rollers 38 is positioned under the top ends of the bags in the magazine.

The rollers 38 at the upper end of the bag magazine are set at an angle with respect to the rollers 33 at the lower end of the bag magazine so that the bags when placed in the magazine will bend near the centers of the bags over the rollers 33 and 36 on the bag support roll shaft 35 and assume a generally arcuate position (FIG. 2). It has been found that, from the standpoint of ideal cycling, clearance for the lower vacuum picker assembly, and the pressure imposed on the rollers 33 and 36 on the bag support roll shaft, the lower ends of the bags in the magazine should be at angle between approximately 10° and 30° from the vertical. The upper ends of the bag can be at an angle between approximately 10° and 25° greater than the angle for the lower ends of the bags. The machine with the bags set at different angles will function, but it may require other changes in the machine to obtain ideal operation. After the upper magazine side members have been properly spaced for the width of the bags and the lower members 15 have been properly positioned for the length of the bags the magazine can be loaded with a large stack of bags. To force the bags into the generally arcuate position over the bag support rollers 33 and 36 and to hold the bags down on the stack a curved weighted bag retainer 39 is merely placed on the top of the stack. To help align the bags against the lower members 15 the vibrator 27 mounted on the plate 17 is run during the time the bag hanger is in use. Thus a face of the bottom bag in the magazine rests on the rollers 33 and 36 with the top end of such bottom bag resting against rollers 38, the bottom edges of the bags in the stack are resting against members 15, the side edges at the tops of the bags positioned within the L-shaped side members 24, and the whole stack of bags is bent over the rollers 33 and 36 on the bag support roll shaft 35.

Positioned below the upper portion of the bag magazine is a lower vacuum bag picker assembly adapted to grip the bottom face of the bottom bag in the magazine. Such assembly consists of a lower vacuum arm 40 which pivots from the bag support roll shaft 35, an air cylinder 41 attached to such arm 40, a rod 42 connecting a lower vacuum manifold 43 to the arm 40, and vacuum cups 44 affixed to the manifold 43. Affixed to the rod 42 is a bag support finger **42*a* which is positioned to contact the center of the face of the bottom bag and straighten out such face if it is bulging outwardly. When the air cylinder 41 is actuated the lower bag picker assembly rotates upwardly to bring the vacuum cups 44 against the face of the bottom bag in the magazine at the top end of such bag. The vacuum cups will apply vacuum to such face adjacent to the rollers 38. When the lower bag picker assembly rotates downwardly, the upper end of the bottom bag is pulled from the magazine and brought to a horizontal position (FIG. 2). To support the bag in such horizontal position a support plate 45 is mounted on a bag support plate mounting bar 45*a* running across the frame 10 (FIG. 1**). Such plate is positioned to come between the vacuum cups at the lower vacuum bag picker rotates upwardly and downwardly.

After the upper end of the bottom bag of the magazine has been pulled down to a horizontal position the upper vacuum bag opener assembly will open the upper end of the bag. Such assembly consists of an opener cylinder support bracket 46 formed of two spaced plates affixed to the main frame, a mounting bracket 47 pivotally affixed to a shaft 48 running between the plates of support bracket 46, a drop cylinder 49 affixed to the mounting bracket 47, an upper vacuum manifold 50 affixed to the upper cylinder 49 and vacuum cups 51 affixed to the manifold 50. In addition there is an air cylinder mounting bracket 52 affixed to support bracket 53, an air cylinder pump 54 affixed to the bracket 52, and a linkage 55 on the shaft of the air cylinder which is affixed to the upper end of the cylinder 49. The air cylinder 54 is adapted with a short stroke to rotate the cylinder 49 affixed to the shaft 48 sufficiently to move the cylinder, manifold and vacuum cups out of the way of the lower vacuum bag picker assembly when the said assembly rotates upwardly and downwardly. When the upper end of the bottom bag from the magazine is positioned on the support plates 45, the upper cylinder 49 has been moved back to a vertical position with the vacuum cups over the end of the bag on the plates 45. The cylinder is actuated to move the vacuum cups 51 downwardly to bring the said cups against the upper face of the bag. The vacuum cups 51 apply vacuum to such face and then move upwardly to raise the upper face of the bag. Since the lower vacuum cups 44 are still applying vacuum to the lower face of the bag, the end of the bag will be opened.

After the end of the bag has been opened a transfer arm mechanism comes into play to clamp the bag in the side edges of the bag, to pull the bag completely from the magazine, and to transfer the opened bag to a filling spout or to clamps to hold the bag under the filling spout. Referring to FIG. 1 the transfer arm mechanism is supported from a main drive shaft 56 extending across the main frame. Such mechanism includes a pair of outer bag clamp arms 57 spaced from each other so that they will contact the outer surfaces at the side edges of the bag being hung. Each outer bag clamp arm is mounted on an arms adjusting screw 58 by means of plate 59 and an arm nut 60. A wheel crank handle 61 permits rotation of the screw 58 to move the outer bag clamp arms together or apart depending on the width of the bag.

The plates 59 to which the arms 57 are affixed, are secured to arm guide nuts which permit the plates and arms to move along the shaft 56 as the arms are spaced on the adjusting screw. The screw 58 is affixed by screw clamp rollers 62 to the main drive shaft 56 so that rotation of the main drive shaft 56 will likewise rotate the adjusting screw 58. The shaft 56 projects through the main frame and has a crank arm 64 affixed to it. Connected to the crank arm 62 is an air cylinder 65 having its opposite end secured to the main frame by a bracket 66. When the air cylinder is activated it rotates the crank arm 65 and the main drive shaft 56 which swings the outer transfer arms 57 through a substantially 90-degree arc.

Affixed to each inner side of the outer bag clamp arm 57 is a swivel bracket assembly 67 (FIG. 1). Secured to the assembly 67 is an inner bag clamp arm 68 which can rotate from a position substantially parallel to the outer bag clamp arm to which it is mounted. Also connected to the assembly 67 is an air cylinder 69 having its opposite end secured to the outer bag clamp arm by a bracket 70. The air cylinders 69 are adapted to rotate the inner bag clamp arms through arcs from a position substantially parallel to the outer bag clamp arm to a position at an angle to such outer bag clamp arm. Affixed to the lower ends of the outer bag clamp arms are fingers 71. Similarly affixed to the lower ends of the inner bag clamp arms are fingers 72 which are longer than the fingers 71 so that they can extend into the bag without the inner arm distorting the end of the bag. The fingers 71 and 72 are mated so that they will effectively grip the edges on each side of the bag.

Figure 4:
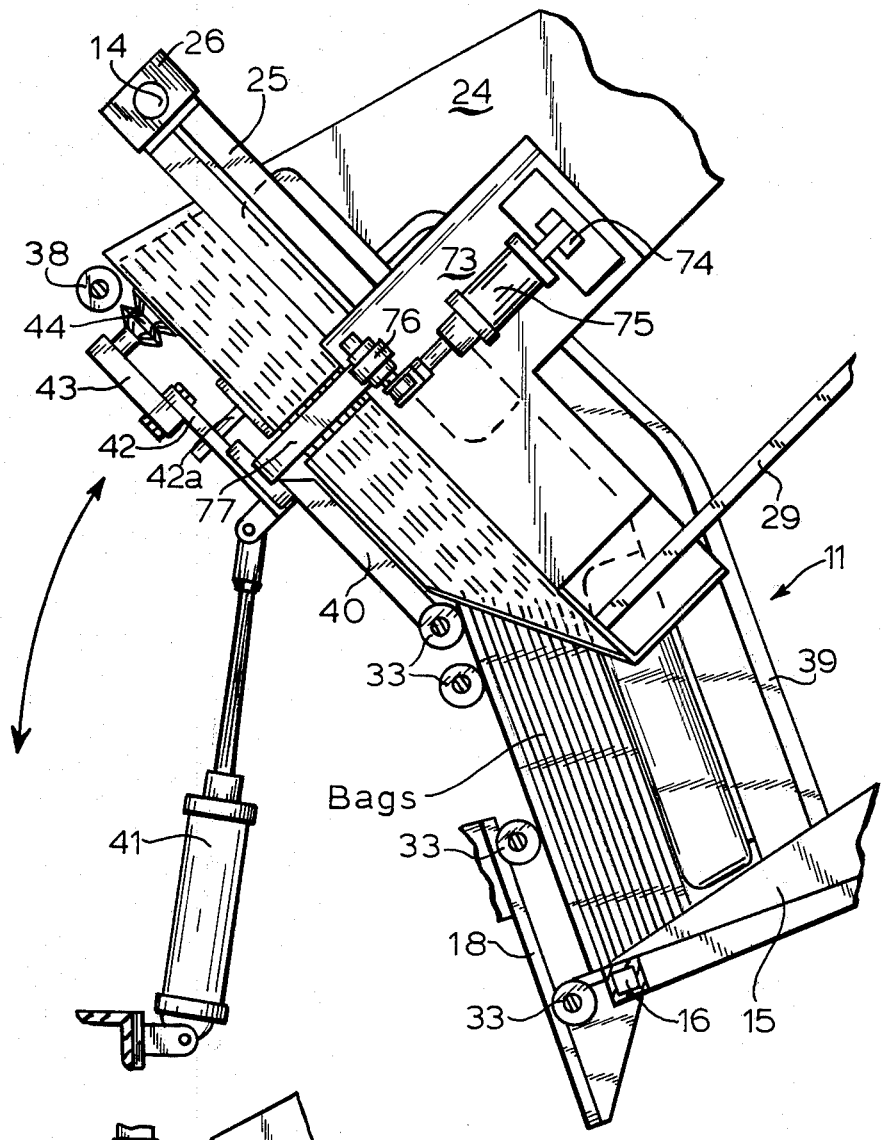
FIG. 4 is an enlarged side elevation of the bag magazine showing the lower vacuum cups gripping one face of the end of the bottom bag in the magazine.

Mounted on the outer side of each magazine side member is a gripper assembly which consists of a plate 73 affixed to the member, a bracket 74 to which is secured one end of an air cylinder 75, a crank arm 76 secured to the plate 73 with the opposite end of the air cylinder connected to the crank arm, and a curved gripper 77 connected to the crank arm (FIG. 4). The curved grippers and assemblies on each side of the magazine are positioned and adapted, when the cylinders are activated, to bring the grippers under the stacked bags approximately between the top ends of the bags and the portions of the bags resting on the bag support roll shaft 35. These grippers will serve to release the pressure of the stacked bags and permit the bottom bag to be pulled from the stack.

The bag hanger of the present invention operates as follows: The magazine is adjusted for the width and length of the bags to be filled by spacing the side members 24 for the width and moving the members 15 upwardly or downwardly so that the tops of the bags will rest on the segmented rollers 38 (FIG. 2). The bags are then stacked in the magazine with the bottom bag in the stack resting on the rollers 33 and 36, the top edge of such bottom bag resting against rollers 38, the bottom edges of the bags in the stack resting against the members 15, the side edges at the tops of the bags positioned within the L-shaped side members 24 and the whole stack of bags bent into an arc over the rollers 33 and 36 on the bag support roll shaft 35. The vibrator 27 is turned on.

Figure 8B:
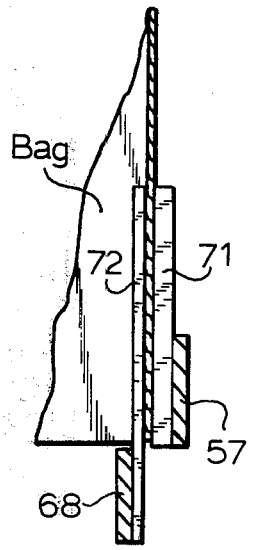
FIG. 8*b* is an enlarged fragmentary sectional view taken on the line 8*b*—8*b* of FIG. 8*a;*
Figure 5:
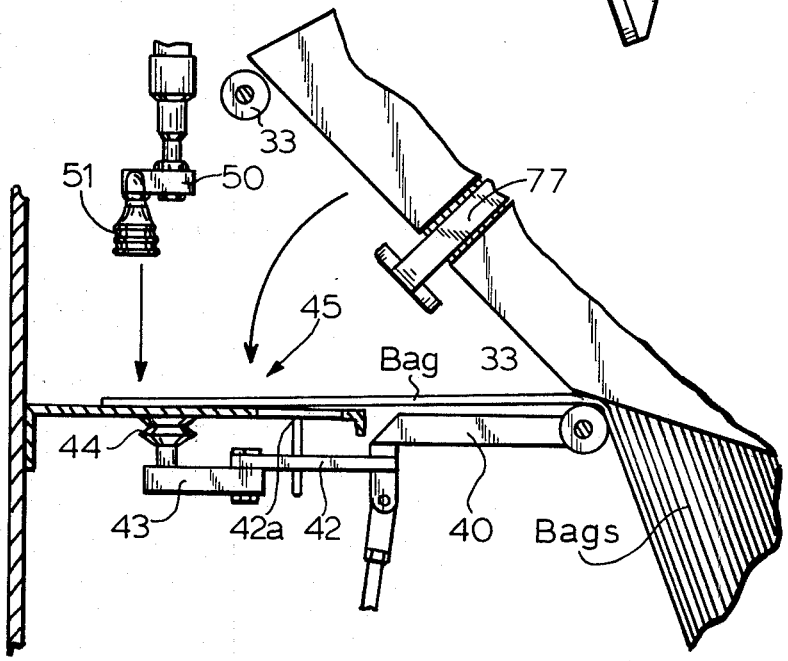
FIG. 5 is a view similar to that of FIG. 4 showing the end of the bottom bag removed from the magazine.
Figure 8A:
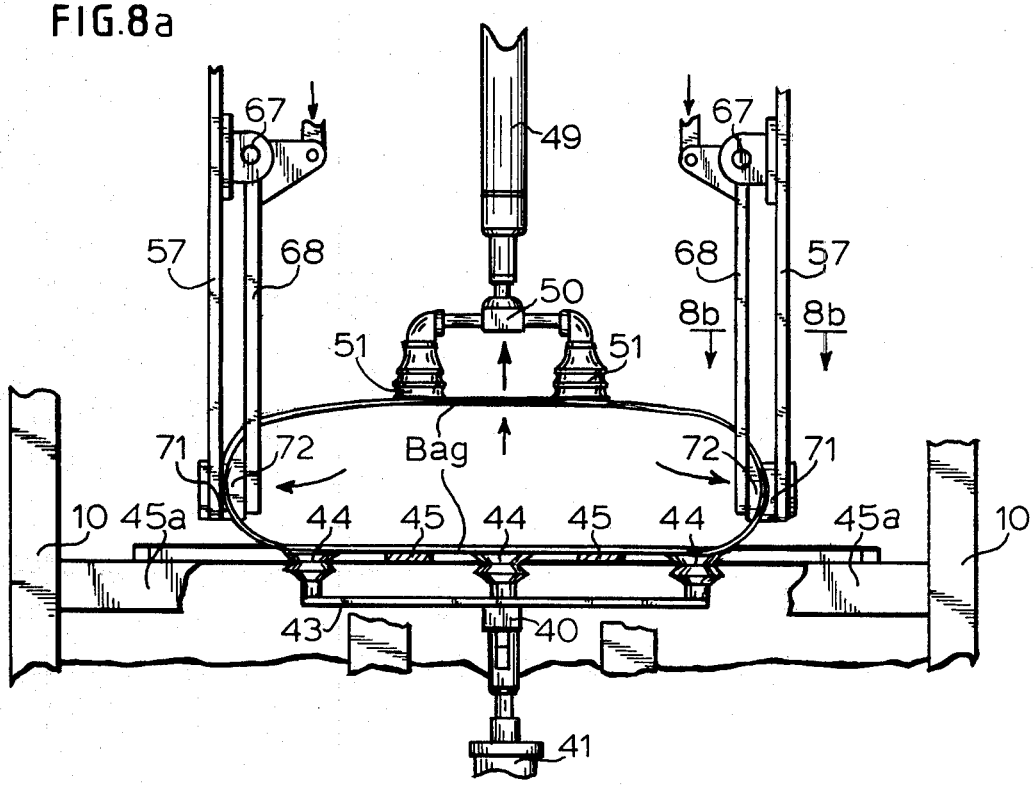
FIG. 8*a* is a view similar to that of FIG. 6 with the bag opened and the fingers of the bag clamp arms holding the side edges of the bag.
Figure 6:
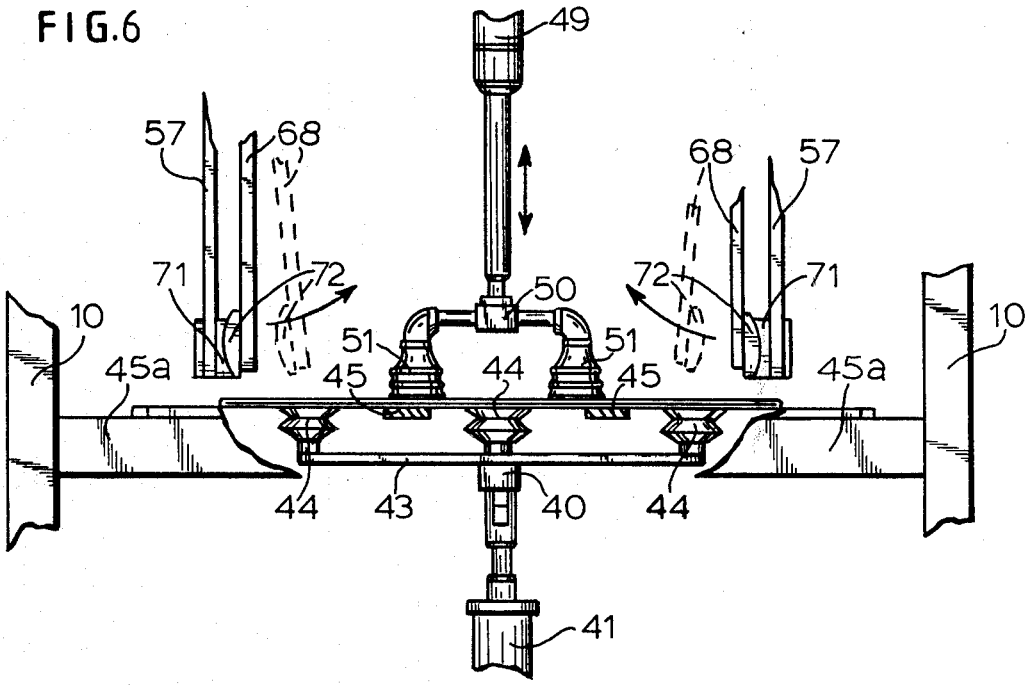
FIG. 6 is a front view of the end of the bottom bag in the magazine with the upper and lower vacuum cups gripping the opposite faces of the bag.
Figure 9:
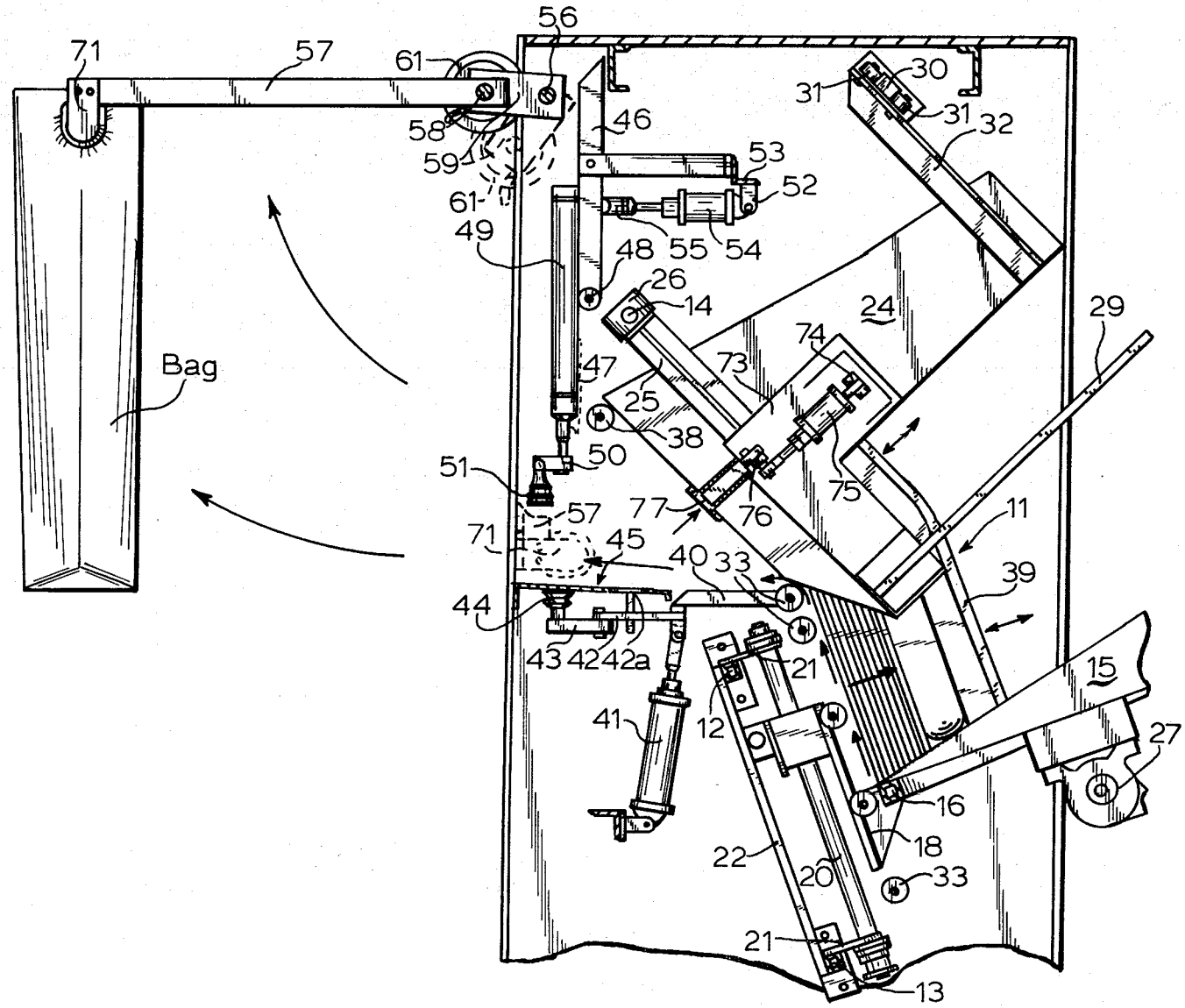
FIG. 9 is a view similar to that of FIG. 2 with the bag removed completely from the magazine and delivered to the bag clamp of a filling spout.

When the unit is turned on the transfer arms 57 rotate on the main drive shaft 56 to move such arms to a horizontal position (FIG. 9). The air cylinder 41 is activated to rotate the lower vacuum arm 40 around the bag support roll shaft 35 and bring the lower vacuum cups 44 into contact with upper end of the bottom bag in the stack (FIG. 4). Almost simultaneously the air cylinder 75 is activated to rotate the curved grippers 77 away from the bottom of the stack of bags. The air cylinder 54 is activated to rotate the cylinder support bracket 46 and the upper vacuum bag opener assembly a short distance from the vertical so that it will be out of the way of the lower vacuum assembly when the lower vacuum arm 40 rotates upwardly to grip the bottom bag. The vacuum cups 44 apply vacuum to the top end of the bottom bag and the air cylinder 41 rotates the lower vacuum arm 40 downwardly to position the upper portion of the said bottom bag on the support plate 45 (FIG. 5). The upper vacuum bag opener assembly is now returned to a vertical position with the upper vacuum cups 51 directly over the top end of the bag on the support plates 45. The upper air cylinder 49 is activated to move the upper vacuum cups 51 downwardly against such bag (FIG. 6). Vacuum is applied through the upper vacuum cups 51 with vacuum still being applied through the lower vacuum cups 44 against the bottom face of such bag. The air cylinder 49 now moves the upper vacuum cups 51 upwardly to open the end of the bag (FIGS. 7–8*a*).

Figure 7:
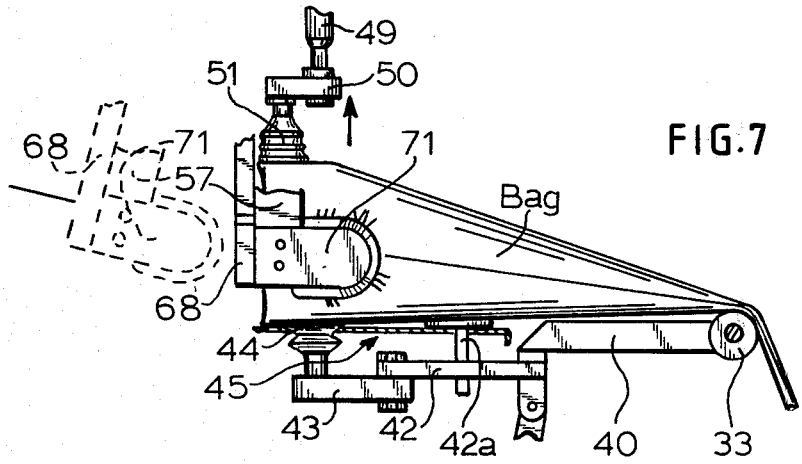
FIG. 7 is a side view of the end of the bottom bag shown in FIG. 6 with the bag opened by the upper and lower vacuum cups and the fingers of the bag clamp arms ready to grip the side edges of the bag.

The air cylinder 65 is activated to rotate the main drive shaft 56 and move the transfer arms 57 from a horizontal position into a vertical position which brings the fingers 71 on the outer bag clamp arm 57 against the outside faces at the edges of the bag (FIG. 7). The inner bag clamp arms 68 at this stage have been moved away from the outer bag clamp arm 57 by the action of the air cylinders 69 (see dotted inner bag clamp arms in FIG. 6). The air cylinders 69 now move the inner bag clamp arms 68 toward the outer bag clamp arms 57 to bring the fingers 72 on the inner bag clamp arms 57 against the inside faces at the side edge of the bag (FIG. 8*a*). The mating fingers 71 and 72 tightly grip the bag at the side edge or gusset areas (FIG. 8*b*).

The air cylinders 75 are now activated to rotate the curved grippers 77 under the stacked bags to release the weight and pressure of the stacked bags against the segmented rollers 33 and 36 on the bag support roll shaft 35. The air cylinder 65 now rotates the main drive shaft 56 and the transfer arms carrying the bag from the vertical position to a horizontal position. This action pulls the bottom bag completely from the stack of bags in the magazine and brings the opened bag into a vertical position onto the clamps of a filling spout.

The cycle is then repeated to remove the next bag from the stack of bags in the magazine.

Those skilled in the art will appreciate that many variations of the above described embodiment may be made without departing from the spirit and scope of the invention.

What is claimed is:

1. A machine for hanging an empty opened bag on the filling spout of a bagging machine, comprising a frame;

a magazine supported by said frame and adapted to hold a stack of collapsed bags;

a bag support roll shaft extending across the central area of the magazine, which shaft will define upper and lower portions for the bags stacked in the magazine and draped over such shaft, the lower portions being positioned at an angle between approximately 10° and 30° from the vertical and the upper portions being positioned at an angle between approximately 10° and 25° greater than the angle for the lower portions;

lower vacuum means to grip the top end of the bottom bag in the magazine and pull the upper portion of the bag downwardly from the magazine to a generally horizontal position;

upper vacuum means cooperating with the lower vacuum means to grip and open the said top end of the said bottom bag;

a pair of spaced transfer arms pivotally mounted at the upper end thereof to said frame above said magazine, the lower ends of said arms being movable between the side edges of said horizontal opened bag and said spout;

means at the lower ends of said arms to clamp the side edges of the said opened bag to the transfer arms; and means for pivoting said transfer arms to pull the bag clamped to the transfer arms completely from the stack in the magazine and transfer such bag to a vertical position on the spout.

2. The machine of claim 1 in which the means to clamp the side edges of the bag comprise a pair of clamping arms pivotally mounted at their upper ends to the confronting faces of said transfer arms, one clamping arm being attached to each transfer arm, and means for pivoting each of said clamping arms toward and away from its associated transfer arm to clamp each side edge of the opened bag to the transfer arm.

3. The machine of claim 1 in which the magazine has mounted thereon a vibrator to help align and position the bags stacked in the magazine.

4. The machine of claim 1 in which curved grippers are positioned and provided with means to rotate said grippers under the stacked bags in the magazine and lift said stack to release the pressure of the stacked bags and permit the bottom bag to be pulled from the stack.

5. The machine of claim 4 in which the curved grippers are mounted on each side of the magazine.

6. The machine of claim 4 in which the curved grippers are located approximately between the top ends of the bags and the portions of the bags resting on the bag support roll shaft.

7. The machine of claim 1 in which means are provided to adjust the width of the magazine for bags of different width.

8. The machine of claim 1 in which means are provided to adjust the length of the magazine for bags of different length.

9. The machine of claim 1 in which the base of the magazine is provided with a plurality of spaced rollers projecting from the frame to support the lower portion of the bags stacked in the magazine.

10. A machine for hanging an empty, opened bag on the filling spout of a bagging machine comprising:

a frame;

a magazine supported by said frame and adapted to hold a stack of collapsed bags;

a bag support roll shaft extending across the central area of the magazine, which shaft divides the magazine into upper and lower portions with the lower portion disposed at an angle approximately 20° from the vertical and the upper portion disposed at an angle between approximately 10° and 25° greater than the angle for the lower portion so that the bags stacked in the magazine and draped over the said shaft will assume a generally arcuate position with the upper portions of the bags on one side of the said shaft and the lower portions of the bags on the other side of the said shaft;

lower vacuum means to grip the top end of the bottom bag in the magazine and pull the upper portion of the bag downwardly from the magazine to a generally horizontal position;

upper vacuum means cooperating with the lower vacuum means to grip and open the said top end of the said bottom bag;

a pair of spaced transfer arms pivotally mounted at the upper end to said frame above said magazine, the lower ends of said arms being movable between the side edges of said horizontal opened bag and said spout;

means at the lower ends of said arms to clamp the side edges of said opened bag to the transfer arms; and means for pivoting said transfer arms to pull the bag clamped to the transfer arms completely from the stack in the magazine and transfer such bag to a vertical position on the spout.

* * * * *